US006457428B1

(12) United States Patent
Vickroy

(10) Patent No.: US 6,457,428 B1
(45) Date of Patent: Oct. 1, 2002

(54) EMBROIDERY MACHINE INTERCHANGEABLE FRAME

(76) Inventor: Bryan K. Vickroy, 6512 192nd Ave. East, Bonney Lake, Pierce County, WA (US) 98390

( * ) Notice: Subject to any disclaimer, the term of this patent is extended or adjusted under 35 U.S.C. 154(b) by 0 days.

(21) Appl. No.: 09/836,140

(22) Filed: Apr. 16, 2001

(51) Int. Cl.[7] ..... D05C 9/10
(52) U.S. Cl. ..... 112/103
(58) Field of Search ..... 112/103, 470.14; 38/102.91

(56) References Cited

U.S. PATENT DOCUMENTS 6,227,129 B1 * 5/2001 Parker, Jr. ..... 112/103

6,240,863 B1 * 6/2001 Vickroy et al. ..... 112/103

* cited by examiner

*Primary Examiner*—Ismael Izaguirre
(74) *Attorney, Agent, or Firm*—James F. Leggett

(57) ABSTRACT

An improved embroidery machine mounting frame apparatus comprised of a support arm, an opposing support arm and an horizontal reach therebetween, being equipped with and an attachment device for removably attaching interchangeable mounting frames, each with a different sewing field dimension, so as to allow insertion of the sewing field into various size pre-sewn garment elements, such as pockets.

1 Claim, 7 Drawing Sheets

EMBROIDERY MACHINE INTERCHANGEABLE FRAME

This is related to my Embroidery Machine Mounting Frame Apparatus and Method which is the subject of U. S. Pat. No. 6,240,863

BACKGROUND OF THE INVENTION

This invention relates generally to automatic computerized embroidery machines, and more particularly to apparatus employed to secure and support backing material fabric in position within the embroidery machine during embroidery operation, and more particularly to ease of changing the size and configuration of the sewing field.

Traditionally, computerized embroidery machines have utilized dual hoop devices for securing and stretching the material to be embroidered by the machine, such as E. Moore U.S. Pat. No. 5,433,158. Adaptations using adhesive material to hold the fabric to be embroidered have also been known, such as L. Moore U.S. Pat. No. 5,546,877 and D. Farb U.S. Pat. No. 6,109,194. These devices still required backing fabric which required time consuming and cumbersome changing of the backing fabric and waste of quantities of the backing material. The need for a device to quickly and securely position backing material within a common computerized embroidery machine was satisfied by my invention which is the subject of U. S. patent application Ser. No. 09/436,905 filed Nov. 9, 199 in Art Group 3741, for which a Notice of Allowance was issued Dec. 16, 2000.

When the prior art, in the form of my prior invention which is the subject of U.S. patent application Ser. No. 09/436,905, was put to use in the embroidery industry, and especially when utilized to place embroidery upon already completed garments, such as pockets on shirts, pant legs, or sleeves, it was discovered that there was a need for an inexpensive means to adapt the Embroidery Machine Mounting Frame Apparatus to various sized and shaped portions of completed garments without the need for purchasing entire Mounting Frames with various sizes and shapes of sewing fields and to make the change of sewing field quick and simple.

SUMMARY OF INVENTION

One object of the present invention is to reduce the cost of placing embroidery upon portions of already completed garments, such as tennis shoes, pockets, pant legs, and sleeves by eliminating the need to purchase a complete Mounting Frame with a different sewing field for each type of garment and dimension of portion to receive embroidery.

A second object is to enable quick and secure change of sewing fields upon Embroidery Machine Mounting Frame without removing said frame from the automatic computerized embroidery machines.

This invention relates generally to an improvement to my Embroidery Machine Mounting Frame Apparatus wherein the portion of the frame encompassing the sewing field is separate from the mounting frame and is made attachable to the mounting frame by suitable means, so that sewing field frames of different sizes and configurations can be utilized with the same basic mounting frame, thus reducing the cost of application of the mounting frame to different sized portions of garments to be embroidered, such as pockets etc. The method of attachment of the sewing field frames to the mounting frame is comprised of two alignment studs equally spaced on either side of a threaded stud, all mounted by suitable means to the top face of the horizontal reach of the mounting frame to which is fitted an interchangeable frame having an anchor plate on one side with a slot in its outside edge to engage the threaded stud on the horizontal reach and tow stud holes to receive the studs on the horizontal reach and an attachment knob with compatible threaded channel to engage the threaded stud and of sufficient diameter to span the slot so when tightened on the threaded stud it secures the anchor plate to the horizontal reach of the mounting frame.

The novel features of the invention will be best understood from the following description in light of the accompanying drawings. While particular embodiments of the present invention are shown and described, it will be obvious to those skilled in the art that changes and modifications may be made without departing from this invention in its broader aspects and, therefore, the aim of the appended claims is to cover all such changes and modifications as fall within the true spirit and scope of this invention.

DESCRIPTION OF THE PREFERRED EMBODIMENTS

Figure 1:
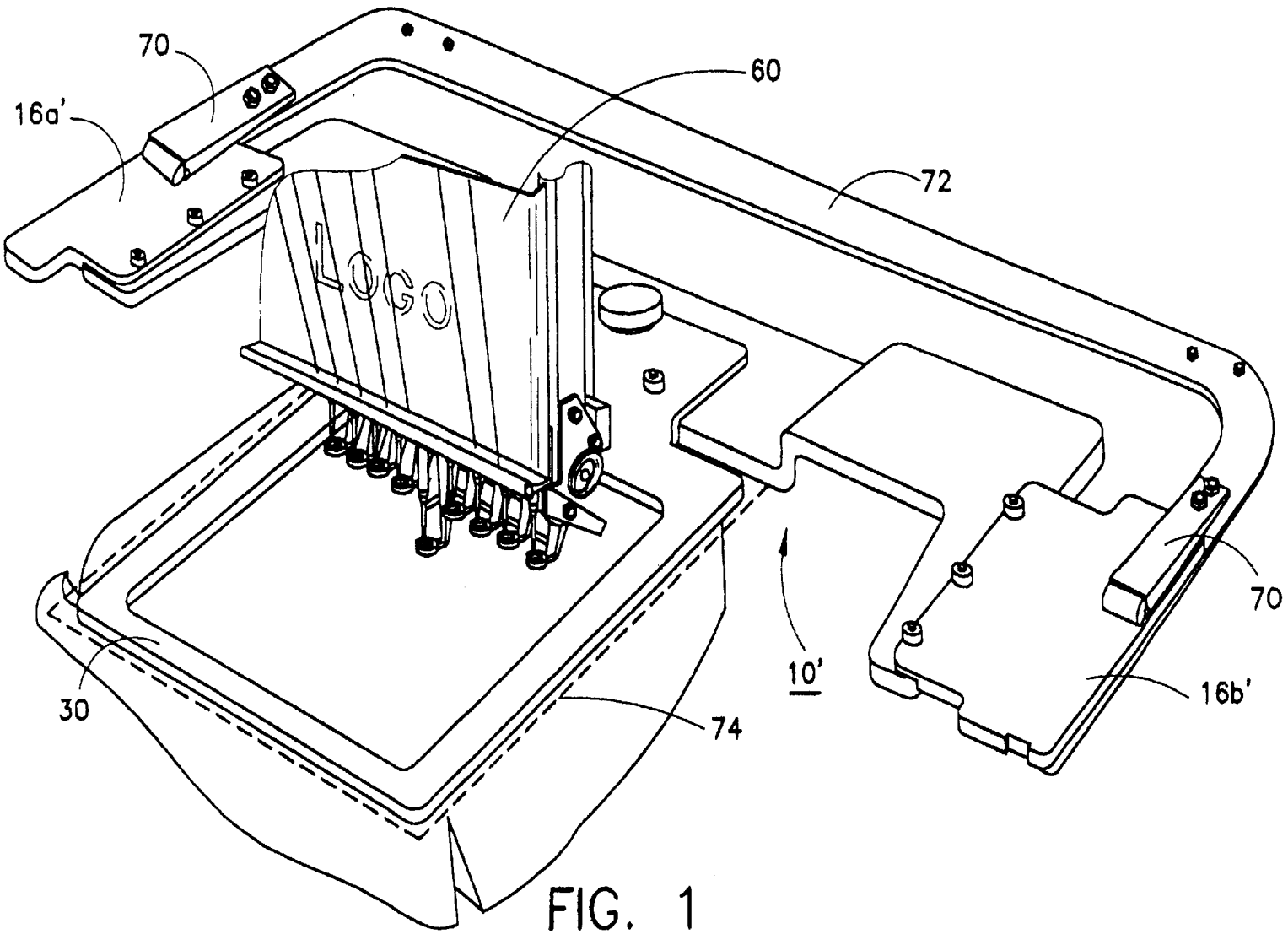
FIG. 1 is a front side perspective view of an automated computerized embroidery machine having a movable support carriage with the mounting frame with interchangeable frame installed.
Figure 2:
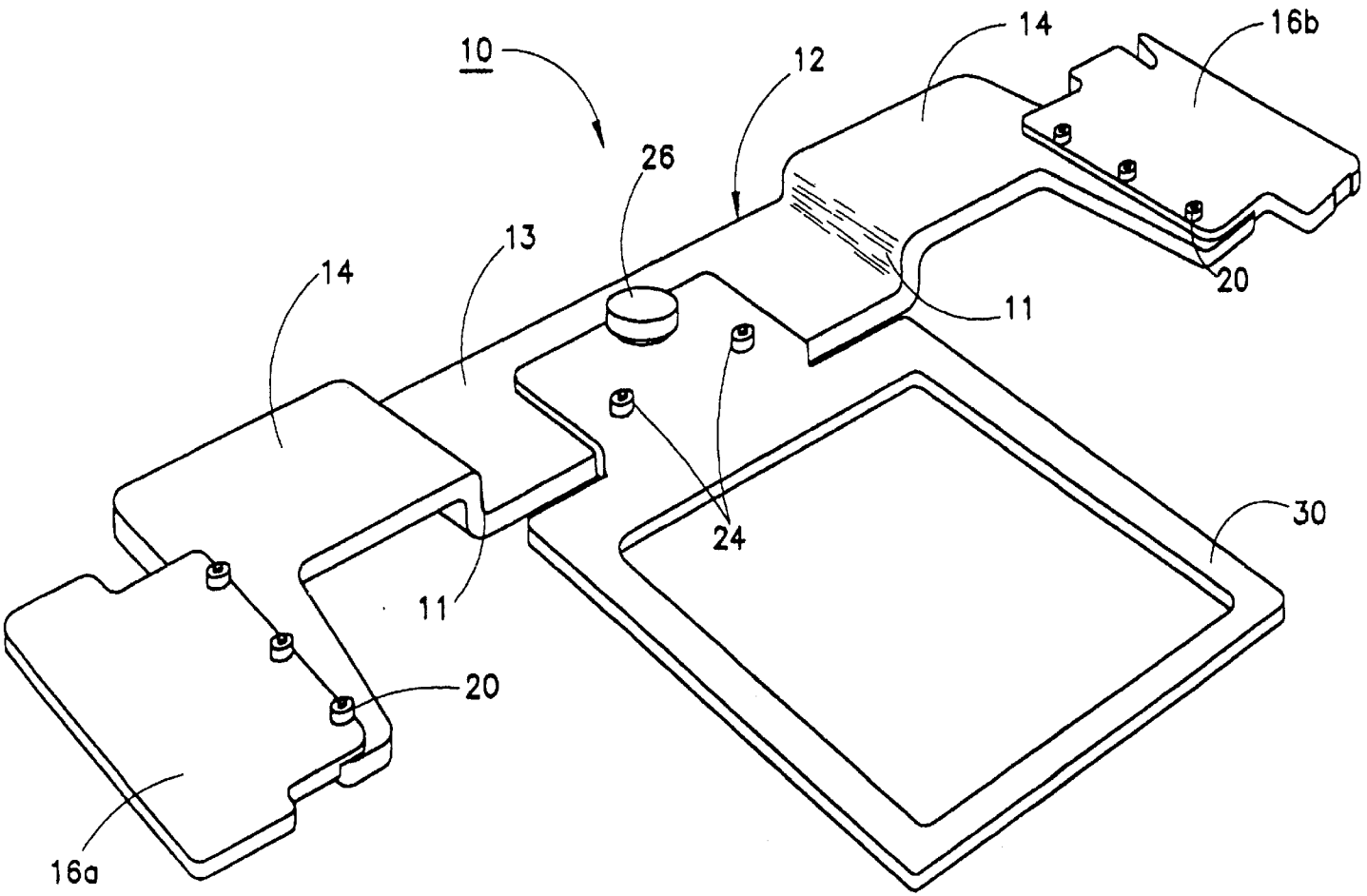
FIG. 2 is a perspective view of the interchangeable frame with adhesive backing material installed with the sewing field disposed within a pocket of a garment.

With reference to FIGS. 1 and 2 the Embroidery Machine Interchangeable Frame is shown installed on an automated computerized embroidery machine (1), having a support carriage (2), a receiving arm (3) and opposing receiving arm (12), retaining spring clamps (11) and tooling points (13) thereon commonly used to support a two-piece hoop frame that maintains a work piece and backing material in correct position within the embroidery machine.

In the preferred embodiment the mounting frame (28), to include the interchangeable frame (9), is formed from sheet metal, having an upper and lower surface, with a support arm (5) formed at one end and an opposing support arm (8) at the other end, both being so shaped as to readily communicate and overlay the receiving arms (3, 12) of the support carriage (2) and having apertures through the thickness of the support arms (5, 8) of proper shape and dimension so as to accommodate with and securely hold the tooling points (4, 13) of the receiving arms (3, 12) therein, and stretching therebetween from the corresponding ends of the receiving arms (3, 12) an horizontal reach to which is removably attached an interchangeable frame (9) of the same material whose lower surface is adapted to receive thereon adhesive backing material (10) oriented so that the adhesive side (14) is facing upward to adhere to the lower surface of the width legs (25) and the length legs (24) of the interchangeable frame forming the sewing field (29).

Importantly, it should be understood that most modern embroidery machines require that the backing material be positioned at a lower elevation than the support surface of the support arms (5, 8). Accordingly, as best seen in FIGS.

3 and 4, the horizontal reach (7) is recessed by means of a support arm step (6) at each end of the mounting frame (28) between the support arms (5, 8) and the horizontal reach (7). Said support arm step (6) is formed by creating a reversing 45 degree bend in the mounting frame (28) to either side of the interchangeable frame (9). Thus the horizontal reach (7) is displaced below the support arms (5, 8).

FIG. 2 discloses the mounting frame (28) with an interchangeable frame removably attached thereto, having adhesive backing material (10) with the adhesive side (14) facing upward and adhesively affixed to the lower surface of the length legs (24) and the width legs (25) of the interchangeable frame, and a pocket (20) already sewn onto the shirt body (21) slipped over the interchangeable frame (9), thereby enabling the embroidery machine to embroider the pocket.

Figure 3:
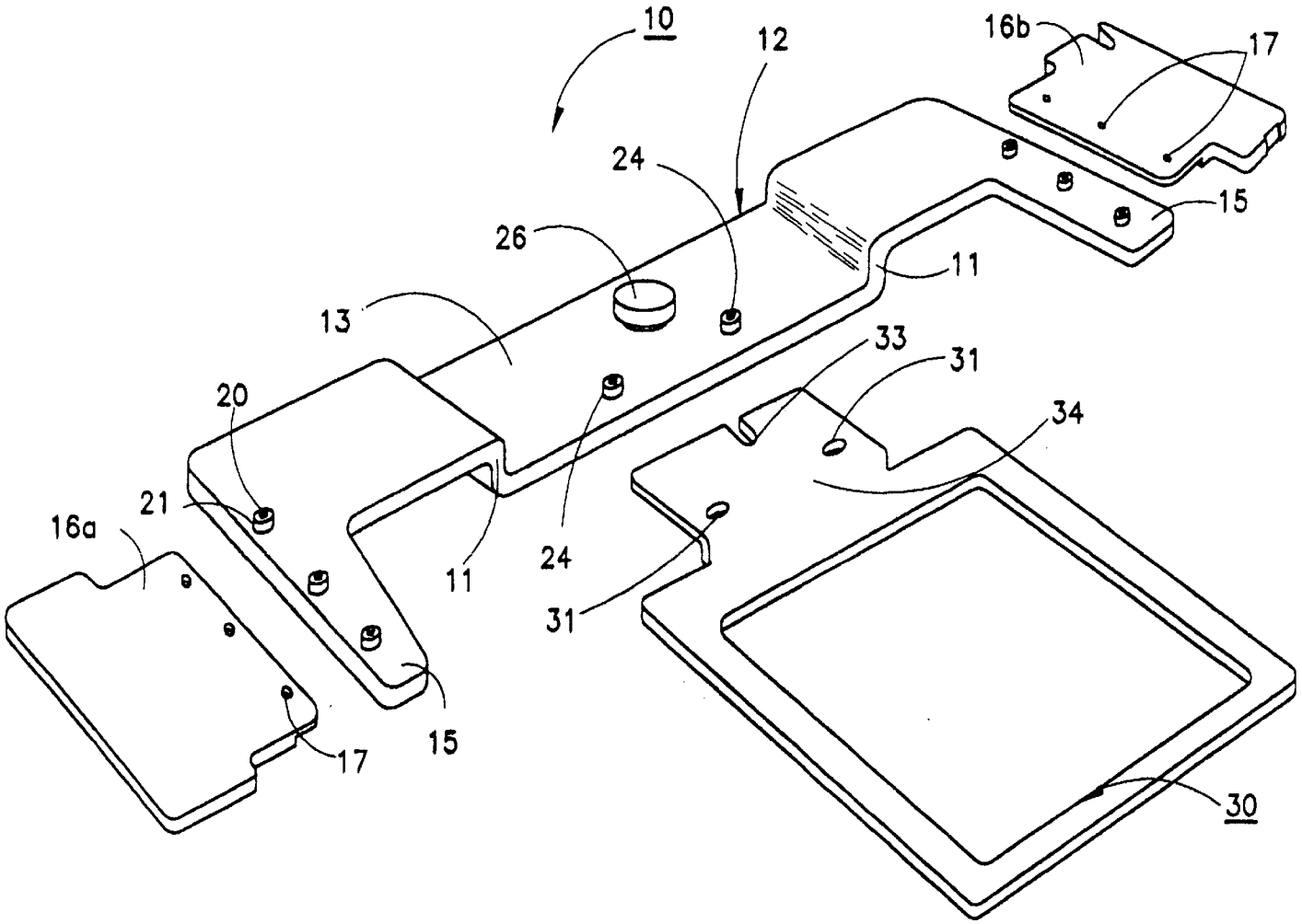
FIG. 3 is a top perspective view of the mounting frame without an interchangeable frame installed.
Figure 4D:
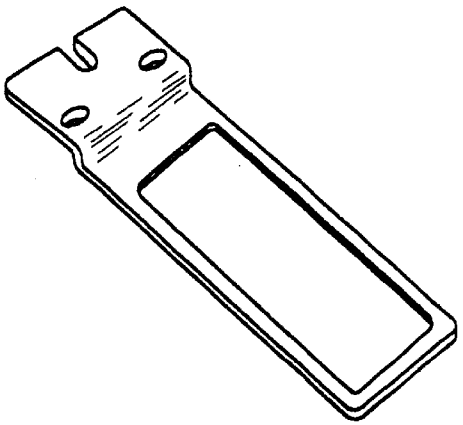
FIG. 4 is a top perspective view of an interchangeable frame.
Figure 4A:
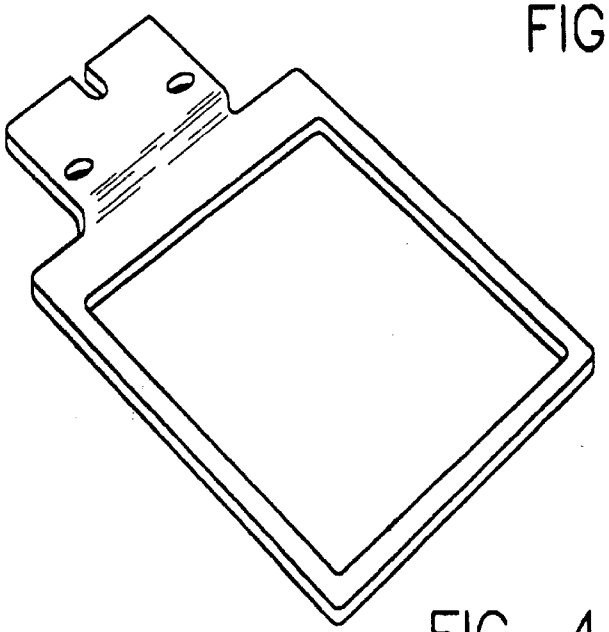
Figure 4C:
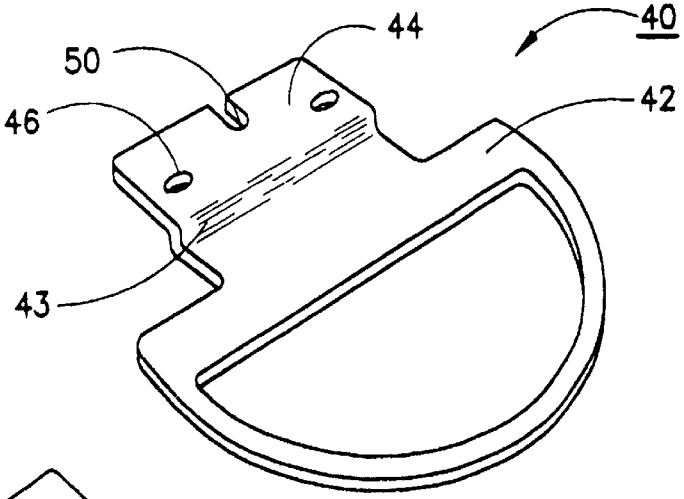
Figure 4B:
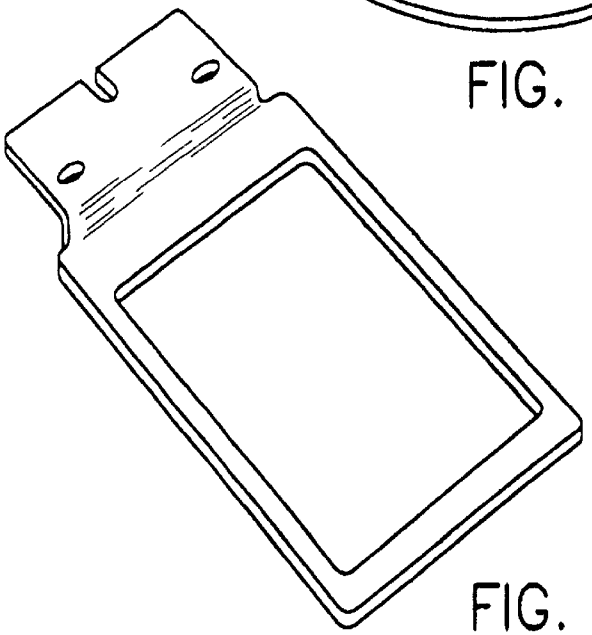
Figure 5A:
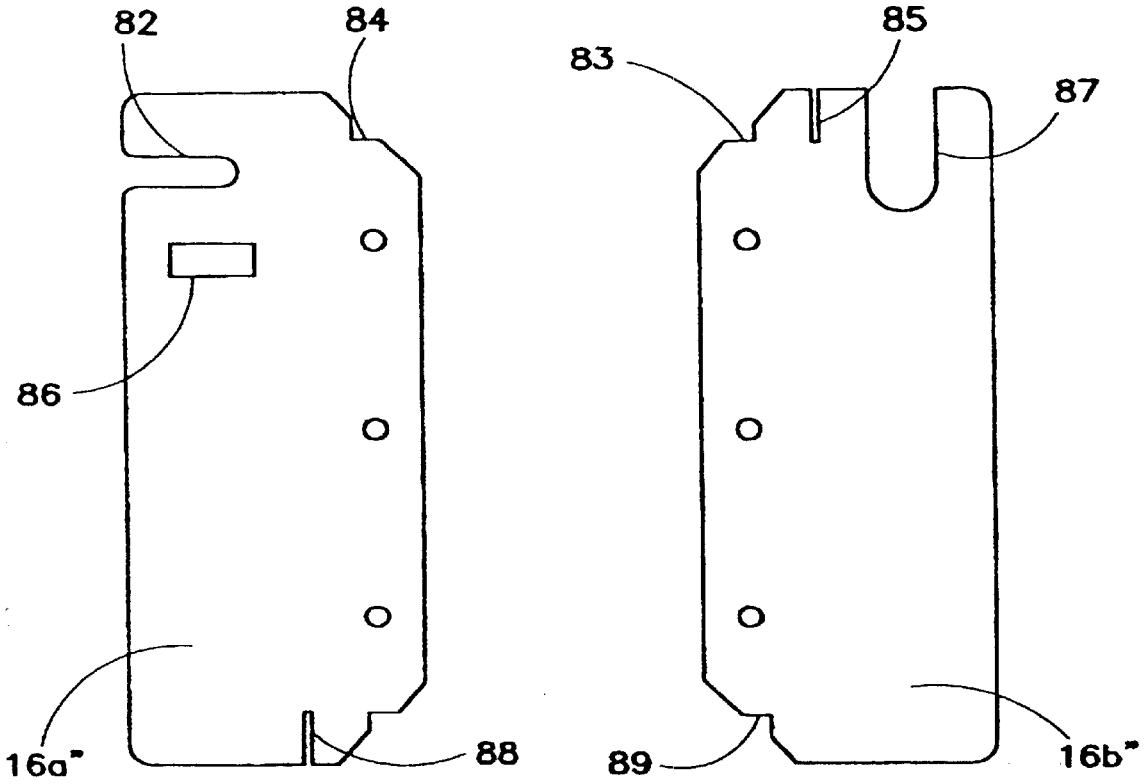
FIG. 5 is a top perspective view of an assortment of interchangeable frames.
Figure 5B:
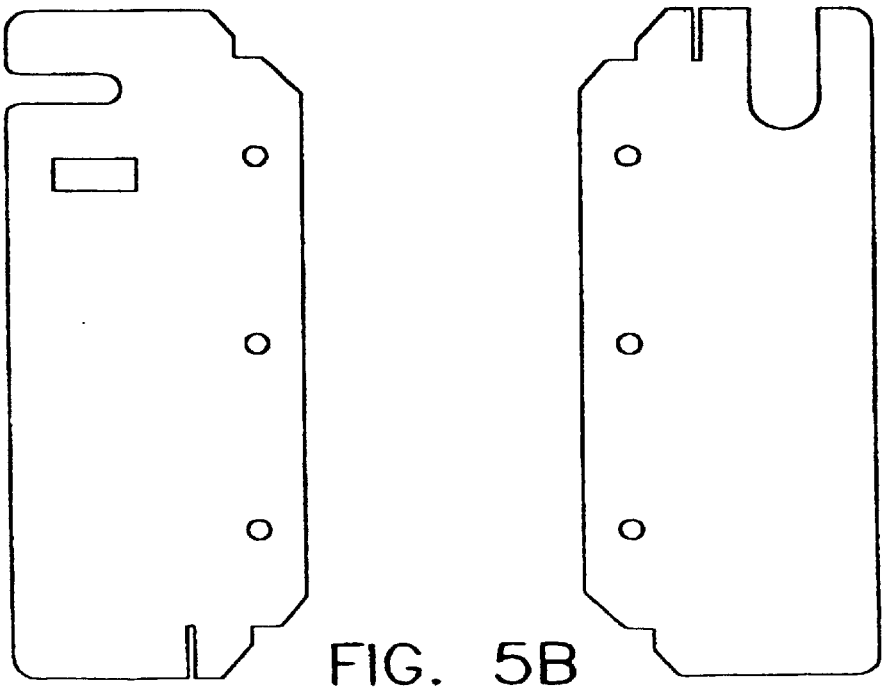
Figure 5C:
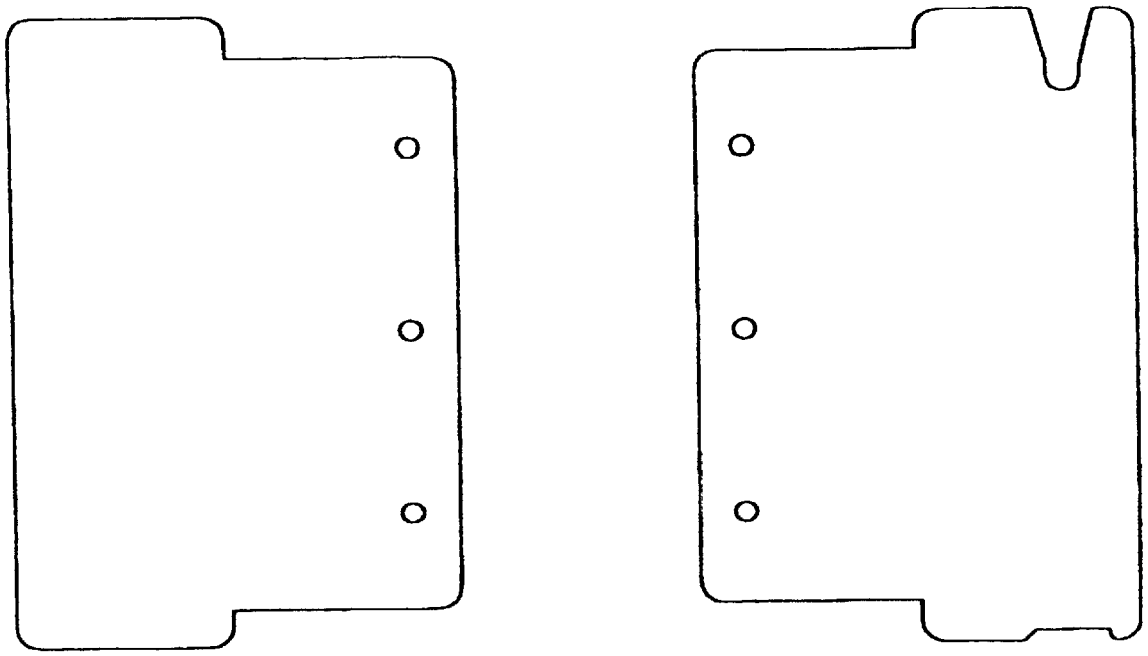
Figure 5D:
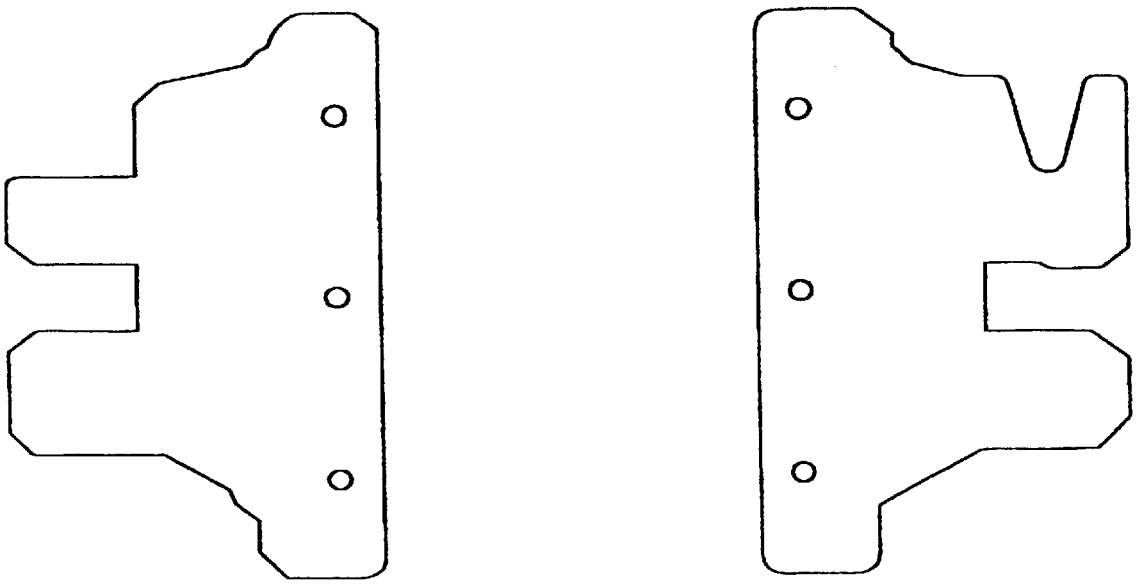
Figure 5E:
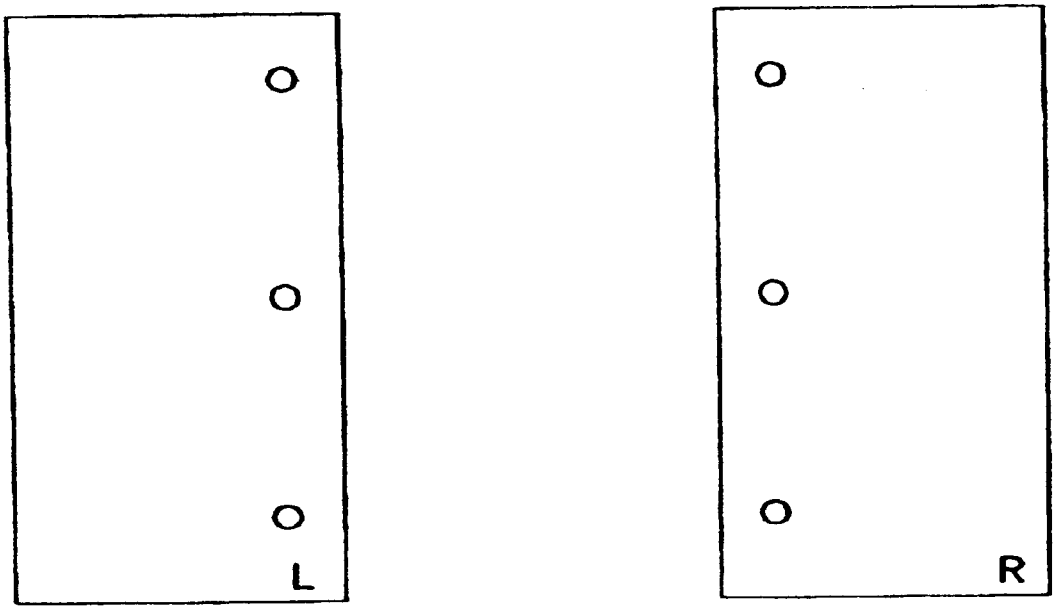

With specific reference to FIGS. 3 and 4, the preferred means of removably attaching the interchangeable frame (9) to the horizontal reach (7) is shown to be comprised of the horizontal reach (7) upper surface being provided with a threaded stud (27) extending therefrom at its mid-point and having a stud (17) extending from and equi-spaced on either side of the threaded stud (27). The interchangeable frame (9) is comprised of an anchor plate, having four sides and of sufficient dimension to overlay the horizontal reach (7) a sufficient amount to rigidly support the length legs (24) and width legs (25) which describe the sewing field (29), having reference notches (19) at opposing points along their lengths, which extends unobstructed therefrom. The anchor plate (26) also has a frame step (16) of reverse 45 degree bends to bring the sewing field (29) down to the level of the horizontal reach (7). In this way, a sleeve, pant leg, shoe and or pocket (20) can be easily positioned over the sewing field (29).

The anchor plate is provided with a slot (23) of sufficient dimension to snugly accommodate the threaded stud (27) at the mid-point on its side opposite to the sewing field (29) and having stud holes through its thickness on either side of said slot corresponding to the studs (17) on the horizontal reach (7), so that when the interchangeable frame (9) is positioned on the horizontal reach (7) it can be secured thereto by tightening an attachment knob (18), with mating threads therein corresponding to the threads on the threaded stud (27), having a diameter sufficient to exceed the width of the slot (23), on the threaded stud (27) against the anchor plate (26). As shown in FIG. 5 the interchangeable frame (9) can have a sewing field (29) of any dimension or configuration so long as the anchor plate (26) remains compatible with the attachment means on the horizontal reach (7).

Improvements and modifications may be made by those skilled in the art without deviating from the scope of the Specification and claims hereof. Accordingly, it is understood that within the scope of the claims appended hereto, the invention may be practiced otherwise than as specifically disclosed herein.

I claim:

1. An improved mounting frame of rigid flat material,with an upper and a lower surface, having two ends and arranged and configured for positioning in an automated computerized embroidery machine, having a support carriage and receiving arms with tooling points for supporting and precisely locating thereon a common two-piece hoop frame, being constructed to secure and support, within an embroidery machine during the embroidery operation, adhesive backing material that includes at least one adhesive side, the mounting frame comprising:

a support arm at one end and an opposing support arm at the other end, both shaped to readily communicate and overlay the receiving arms of the support carriage and having apertures therethrough of proper shape and dimension so as to accommodate with and securely hold the tooling points of the receiving arms, and spanning therebetween an horizontal reach, being displaced below the support arm by a support arm step of reversing 45 degree bends where the support arms communicate with the horizontal reach;

an interchangeable frame means extending unobstructed from and removably attached to the horizontal reach by means of an anchor plate, having four sides and of sufficient dimension to overlay the horizontal reach a sufficient amount to rigidly support an interchangeable frame, two length legs and two width legs field extending from a side of the anchor plate unobstructed beyond the horizontal reach and defining a sewing field, a frame step of reversing 45 degree bends in the side of the anchor plate communicating with the sewing field so that said sewing field is displaced below and in line with the horizontal reach and having opposing alignment notches along the inside perimeter of the four legs, the lower surface thereof being adapted for receipt of an adhesive side of adhesive backing material which spans the sewing field;

removable attachment means for attaching the interchangeable frame to the horizontal reach being comprised of a threaded stud, at the mid-point of the span of the horizontal reach, and two studs, equally spaced on either side of the threaded stud, rigidly protruding from the upper surface of the horizontal reach, and the anchor plate of the interchangeable frame having a slot at the mid-point in the side opposite to the sewing field of sufficient dimension to snugly fit on the threaded stud of the horizontal reach and two stud holes on either side thereof of such dimension and so located so as to receive the two studs protruding from the horizontal reach, and an attachment knob with mating threads corresponding to the threads on the threaded stud therein and being of sufficient diameter to span the slot so that when said attachment knob is tightened on the threaded stud against the anchor plate of an interchangeable frame means, said interchangeable frame is held securely for the embroidery process; and interchangeable frame means being comprised of interchangeable frames having length and width legs of varied lengths, shapes and dimensions to accommodate any embroidery task so long as the anchor plate remains compatible with the attachment means on the horizontal reach.

* * * * *